US010869496B2

(12) United States Patent
Ademe

(10) Patent No.: US 10,869,496 B2
(45) Date of Patent: Dec. 22, 2020

(54) SYSTEMS AND METHODS FOR TESTING HEAT-NOT-BURN TOBACCO PRODUCTS

(71) Applicant: R.J. REYNOLDS TOBACCO COMPANY, Winston-Salem, NC (US)

(72) Inventor: Balager Ademe, Winston-Salem, NC (US)

(73) Assignee: R.J. REYNOLDS TOBACCO COMPANY, Winston-Salem, NC (US)

( * ) Notice: Subject to any disclaimer, the term of this patent is extended or adjusted under 35 U.S.C. 154(b) by 247 days.

(21) Appl. No.: 16/115,387

(22) Filed: Aug. 28, 2018

(65) Prior Publication Data

US 2020/0068944 A1 Mar. 5, 2020

(51) Int. Cl.

| | |
|---|---|
| ***G01K 3/00*** | (2006.01) |
| ***A24B 3/18*** | (2006.01) |
| *A24C 5/34* | (2006.01) |

(52) U.S. Cl.

CPC ..... *A24B 3/187* (2013.01); *A24C 5/34* (2013.01)

(58) Field of Classification Search

CPC ..... A24B 3/187; A24C 5/34; A24C 5/3406; A24F 40/80

See application file for complete search history.

(56) References Cited

U.S. PATENT DOCUMENTS

| | | | | |
|---|---|---|---|---|
| 4,708,151 | A | 11/1987 | Shelar | |
| 4,714,082 | A | 12/1987 | Banerjee et al. | |
| 4,732,168 | A | 3/1988 | Resce et al. | |
| 4,756,318 | A | 7/1988 | Clearman et al. | |
| 5,214,969 | A | 6/1993 | Adkins et al. | |
| 5,284,164 | A * | 2/1994 | Andrews | A24C 5/31 131/280 |
| 5,469,871 | A | 11/1995 | Barnes et al. | |
| 6,276,366 | B1 | 8/2001 | Fuchigami et al. | |
| 7,647,932 | B2 | 1/2010 | Cantrell et al. | |
| 7,836,897 | B2 | 11/2010 | Borschke et al. | |
| 8,424,538 | B2 | 4/2013 | Thomas et al. | |
| 8,464,726 | B2 | 6/2013 | Sebastian et al. | |
| 8,469,035 | B2 | 6/2013 | Banerjee et al. | |
| 8,617,263 | B2 | 12/2013 | Banerjee et al. | |
| 8,678,013 | B2 | 3/2014 | Crooks et al. | |
| 8,839,799 | B2 | 9/2014 | Conner et al. | |
| 9,149,072 | B2 | 10/2015 | Conner et al. | |

(Continued)

*Primary Examiner* — Stephen D Meier
*Assistant Examiner* — Nasir U. Ahmed
(74) *Attorney, Agent, or Firm* — Foley & Lardner LLP

(57) ABSTRACT

Provided herein are systems and methods for testing a heat-not-burn tobacco product. A heater carrier may be movable with respect to a tobacco product placement region and configured to heat a first end of a tobacco product located in the tobacco product placement region. A puffing simulator is configured to fluidically couple to a second end of the tobacco product. The puffing simulator is configured to draw air through the tobacco product thereby simulating a puff of the tobacco product. A thermocouple placement right is configured to selectively position one or more thermocouples in or along the tobacco product. A drill is configured to selectively drill one or more holes at positions within the tobacco product. The thermocouple(s) are positioned on or within the tobacco product and generate data corresponding to detected temperatures of the tobacco product as the puffing simulator simulates one or more puffs.

20 Claims, 8 Drawing Sheets

(56) References Cited

U.S. PATENT DOCUMENTS

| | | | |
|---|---|---|---|
| 9,220,301 | B2 | 12/2015 | Banerjee et al. |
| 9,301,546 | B2 | 4/2016 | Thomas et al. |
| 9,345,268 | B2 | 5/2016 | Stone et al. |
| 9,439,453 | B2 | 9/2016 | Conner et al. |
| 9,486,013 | B2 | 11/2016 | Sebastian et al. |
| 9,788,571 | B2 | 10/2017 | Conner et al. |
| 9,903,784 | B2 | 2/2018 | Ademe et al. |
| 2003/0145868 | A1 | 8/2003 | Halder |
| 2012/0042885 | A1 | 2/2012 | Stone et al. |
| 2012/0285271 | A1 | 11/2012 | Ademe et al. |
| 2015/0157052 | A1 | 6/2015 | Ademe et al. |
| 2016/0073687 | A1 | 3/2016 | Banerjee et al. |
| 2016/0367926 | A1 | 12/2016 | Blackley |
| 2017/0000188 | A1 | 1/2017 | Nordskog et al. |
| 2017/0034008 | A1 | 2/2017 | Puttagunta et al. |
| 2017/0055576 | A1 | 3/2017 | Beeson et al. |
| 2017/0164654 | A1 | 6/2017 | Ademe |
| 2017/0238607 | A1 | 8/2017 | Nordskog |
| 2017/0340008 | A1 | 11/2017 | Sebastian et al. |

* cited by examiner

SYSTEMS AND METHODS FOR TESTING HEAT-NOT-BURN TOBACCO PRODUCTS

FIELD OF THE DISCLOSURE

The present disclosure relates to a testing system and method for heat-not-burn tobacco products.

DISCLOSURE OF RELATED ART

Several different tobacco products are currently on the market including, for instance, cigarettes, smokeless tobacco, vapor pens or e-cigarettes, etc. Recently, heat-not-burn tobacco products have been under development. See, for example, U.S. Pat. Nos. 4,708,151, 4,714,082, 4,732,168, 4,756,318, and 5,469,871, each of which are incorporated by reference in their entirety. Such tobacco products heat the tobacco sufficiently to produce vapors, but do not burn or ignite the tobacco within the tobacco product.

Some testing systems for generally testing tobacco products have been developed. Some testing systems may measure the temperature of a heat source for determining successful ignition (or burning) of tobacco. See, for example, U.S. Pat. No. 9,903,784, which is incorporated by reference in its entirety. Some testing systems may simulate puffing for analyzing the smoke product produced thereby. See for example, U.S. Patent Application Pub. No. 2012/0285271, which is incorporated by reference in its entirety.

While various testing systems for different tobacco products are known, no known testing system provide for sequential or serial testing of tobacco products for simulating use of a heat-not-burn tobacco product. Accordingly, it would be desirable to provide a system and method for more easily and efficiently simulating use of a heat-not-burn tobacco product for optimizing arrangements of the heat-not-burn tobacco product.

SUMMARY

The above and other needs are met by aspects of the present disclosure which, in a first aspect, provides a lightability and temperature profile testing system. The testing system includes a system body defining a tobacco product placement region for testing a tobacco product. The testing system includes a heater carrier movable with respect to the tobacco placement region and configured to heat a first end of a tobacco product. The testing system includes a puffing simulator configured to fluidically couple to a second end of the tobacco product within the tobacco product placement region. The puffing simulator is configured to draw air through the tobacco product thereby simulating a puff of the tobacco product. The testing system includes a thermocouple placement rig configured to selectively position one or more thermocouples in or along the tobacco product located within the tobacco product placement region. The testing system includes a drill configured extend into the system body and selectively drill one or more holes at positions within the tobacco product located within the tobacco product placement region. The testing system includes a controller communicably coupled to the heater carrier, the puffing simulator, the thermocouple placement rig and the drill. The controller is configured to execute instructions to identify, based on a configuration of the thermocouple placement rig, at least one position for drilling a hole in the tobacco product. The controller is further configured to control the drill to drill the hole at the at least one position in the tobacco product. The controller is further configured to position, via the thermocouple placement right, the one or more thermocouples in or along the tobacco product. The controller is further configured to control the puffing simulator to draw air through the tobacco product. While the puffing simulator draws air through the tobacco product, the controller is further configured to generate, based on temperature data from the thermocouples, a temperature profile for the tobacco product.

In second aspect, a method of testing lightability for a heat-not-burn (HNB) tobacco product is provided. The method includes transporting a tobacco product from a hopper to a testing position adjacent to a thermocouple placement rig for testing. The method further includes positioning one or more thermocouples in or along an outer surface of the tobacco product in accordance with a configuration of the thermocouple placement rig. The method further includes positioning a heater at a distance from a first end of the tobacco product. The method further includes controlling a puffer simulator to simulate, by drawing air through a second end of the tobacco product, a series of puffs separated by an interval while the heater heats the first end of the tobacco product. The method further includes generating, based on data from the one or more thermocouples, a temperature profile for the tobacco product. The method further includes determining, based on the temperature profile, whether the distance between the heater and the first end of the tobacco product sufficiently heats the tobacco product to produce vapors.

In a third aspect, a method of simulating use of a heat-not-burn (HNB) tobacco product. The method includes positioning one or more thermocouples in or along an outer surface of a tobacco product in accordance with a configuration of a thermocouple placement rig. The method further includes positioning a heater at a distance from a first end of the tobacco product. The method further includes controlling a puffer simulator to simulate, by drawing air through a second end of the tobacco product, a series of puffs separated by an interval while the heater heats the first end of the tobacco product. The method further includes generating, based on data from the one or more thermocouples, a temperature profile for the tobacco product. The method further includes determining, based on the temperature profile, whether the distance between the heater and the first end of the tobacco product heats the tobacco product to a temperature satisfying a threshold.

Further features and advantages of the present disclosure are set forth in more detail in the following description.

BRIEF DESCRIPTION OF THE DRAWINGS

Figure 1:
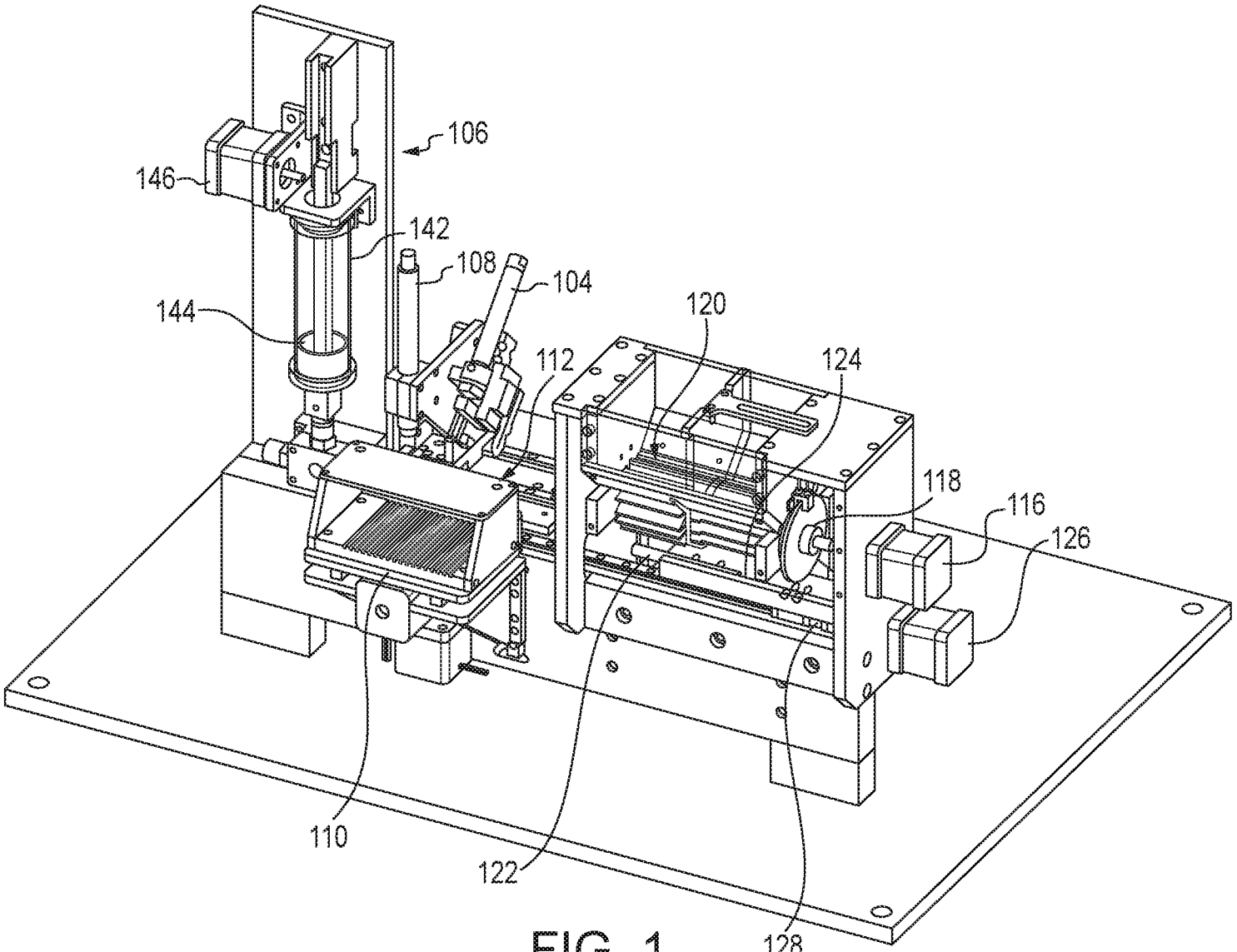
Figure 2:
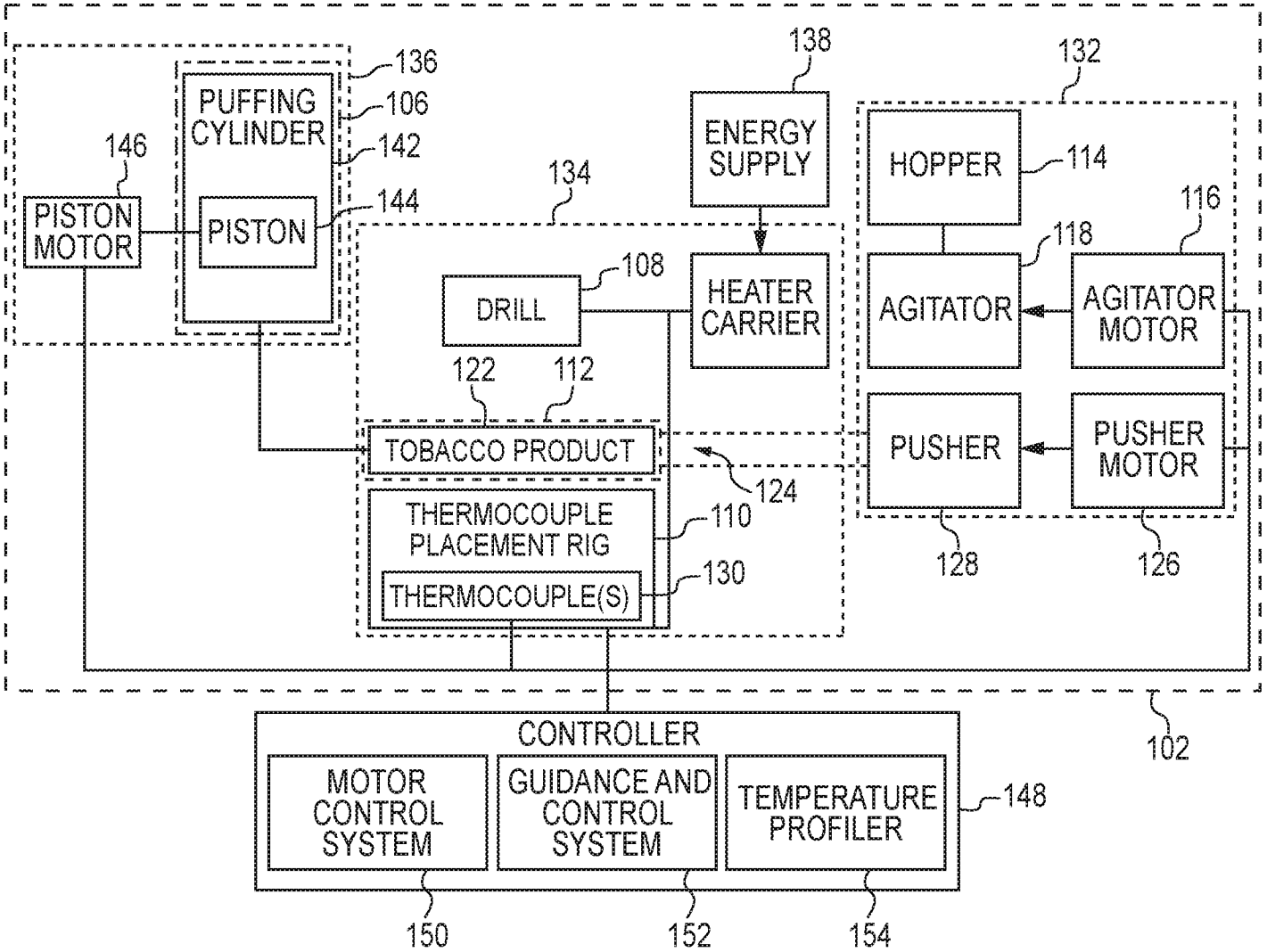
Figure 3:
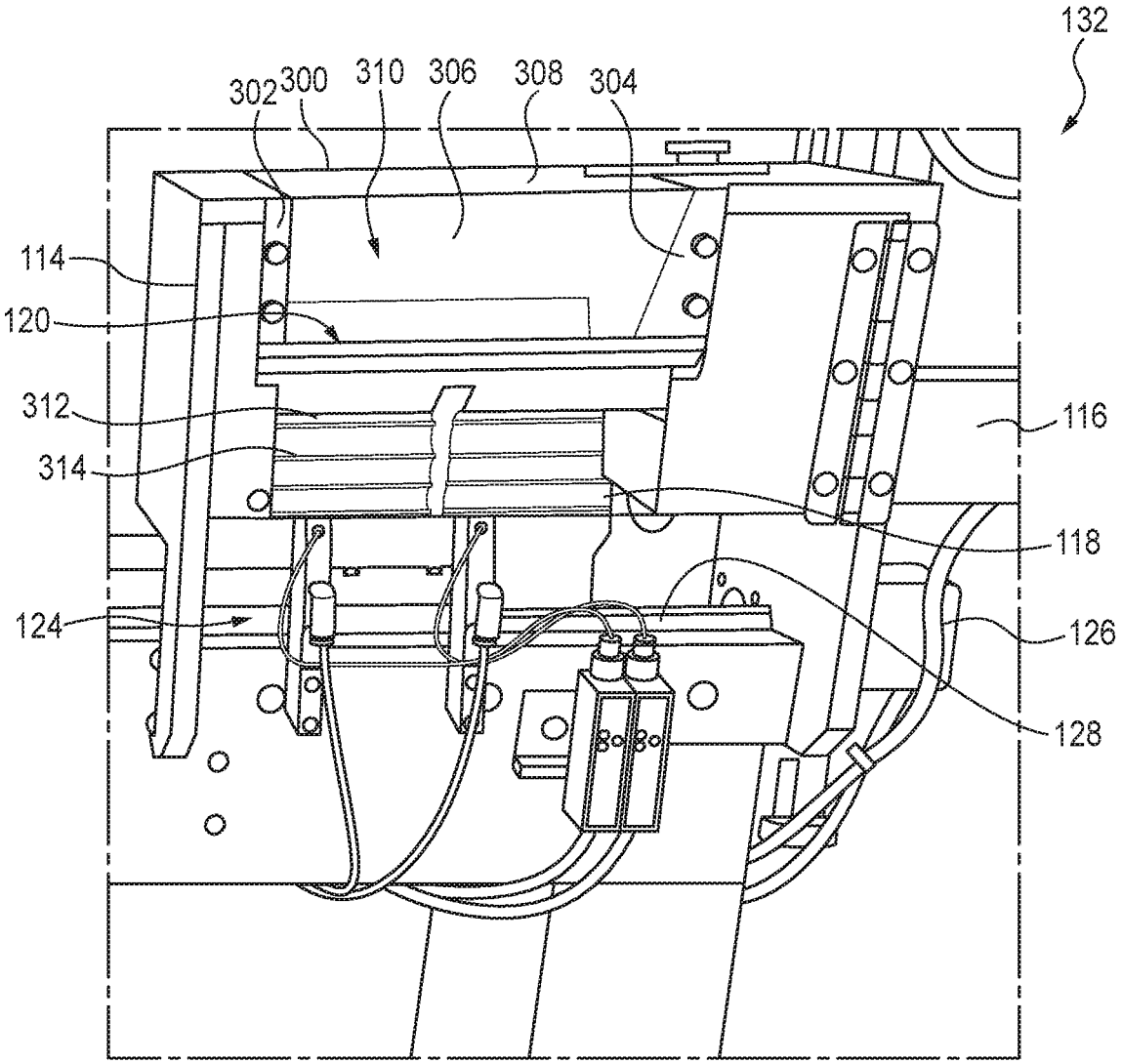
Figure 4:
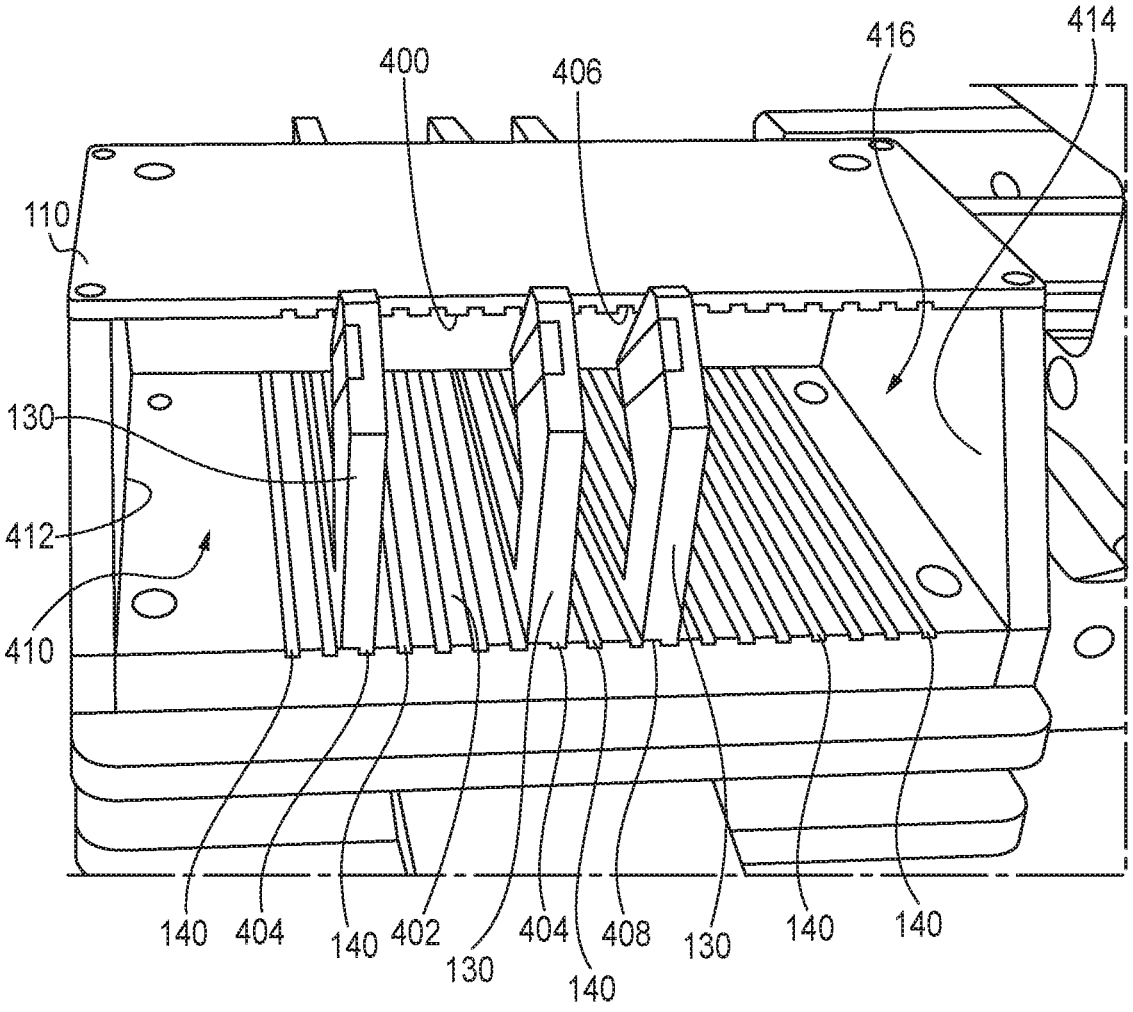
Figure 5:
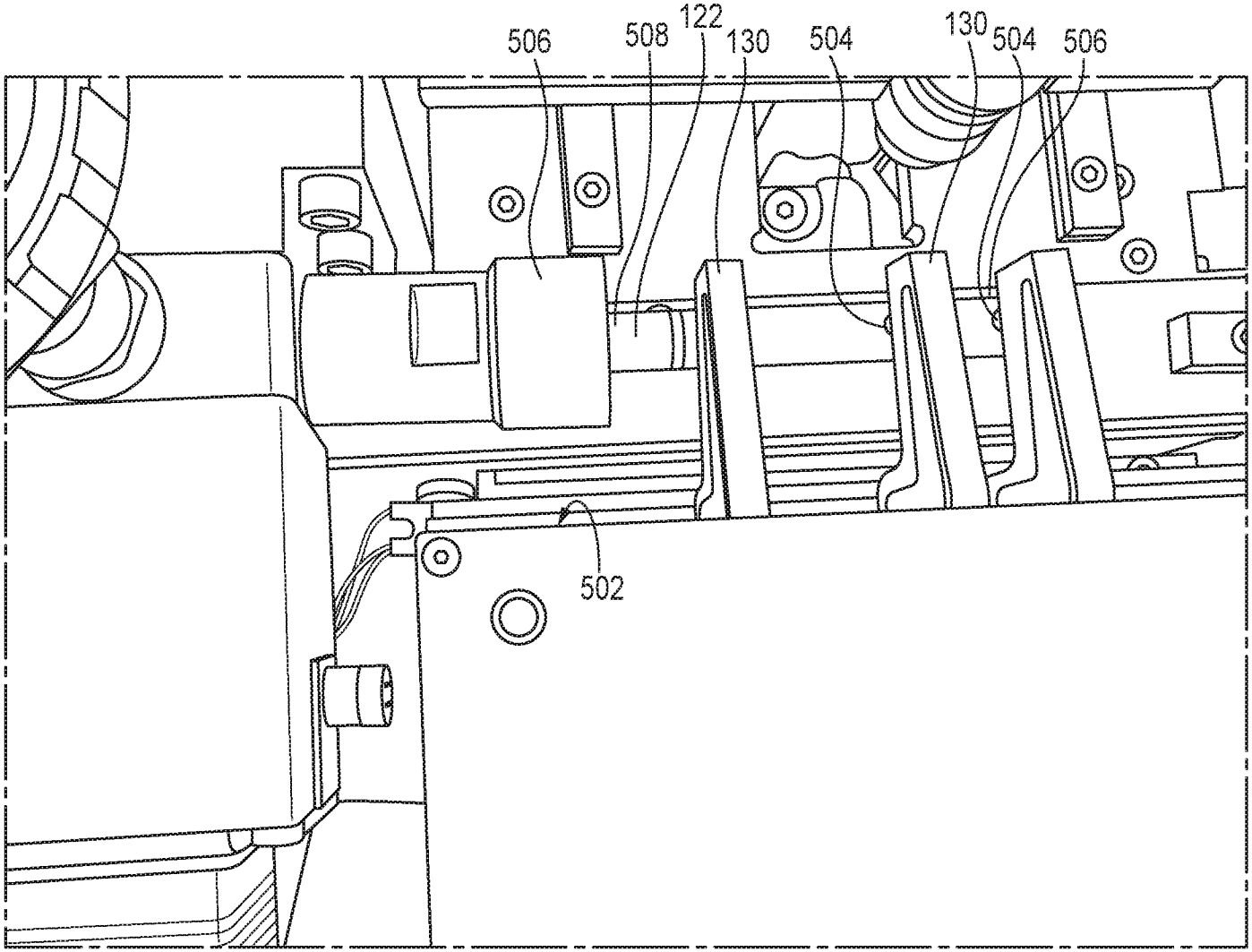
Figure 6:
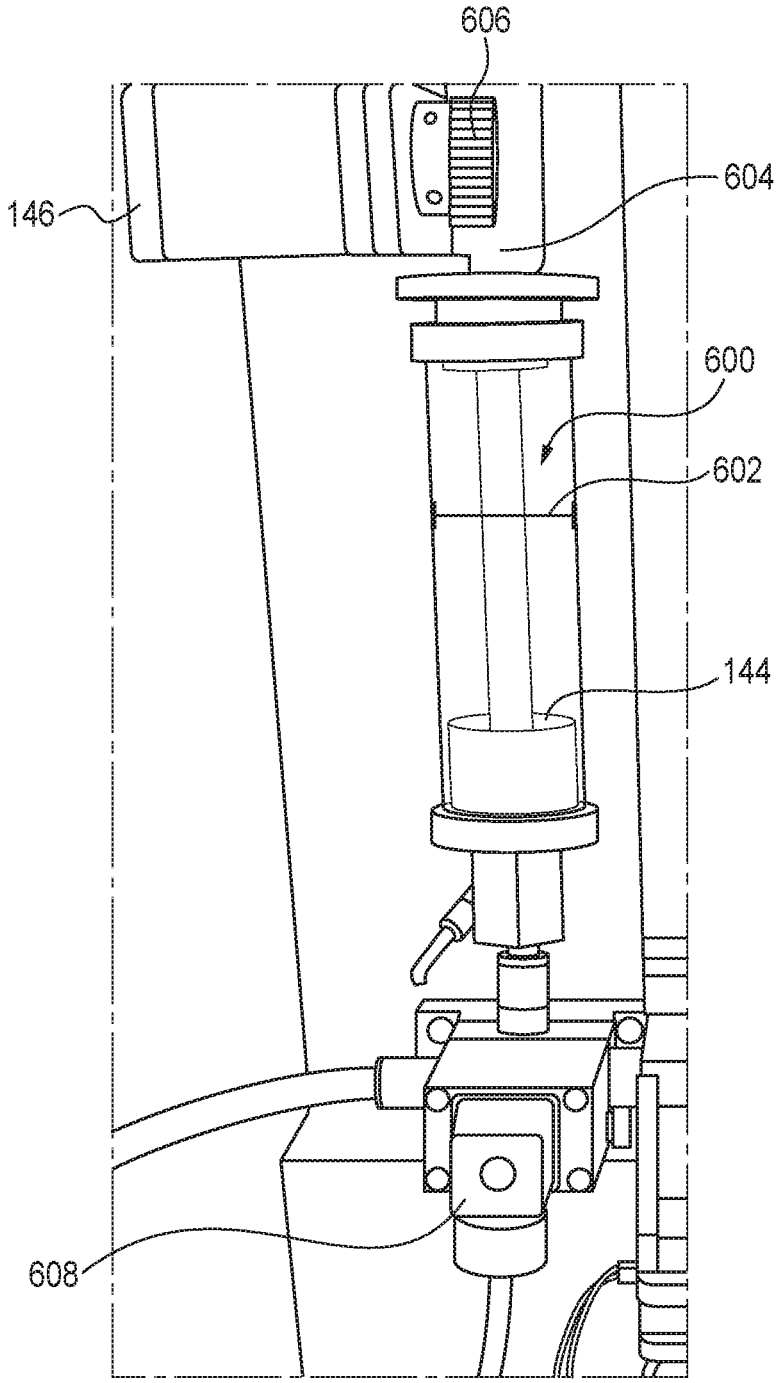
Figure 7:
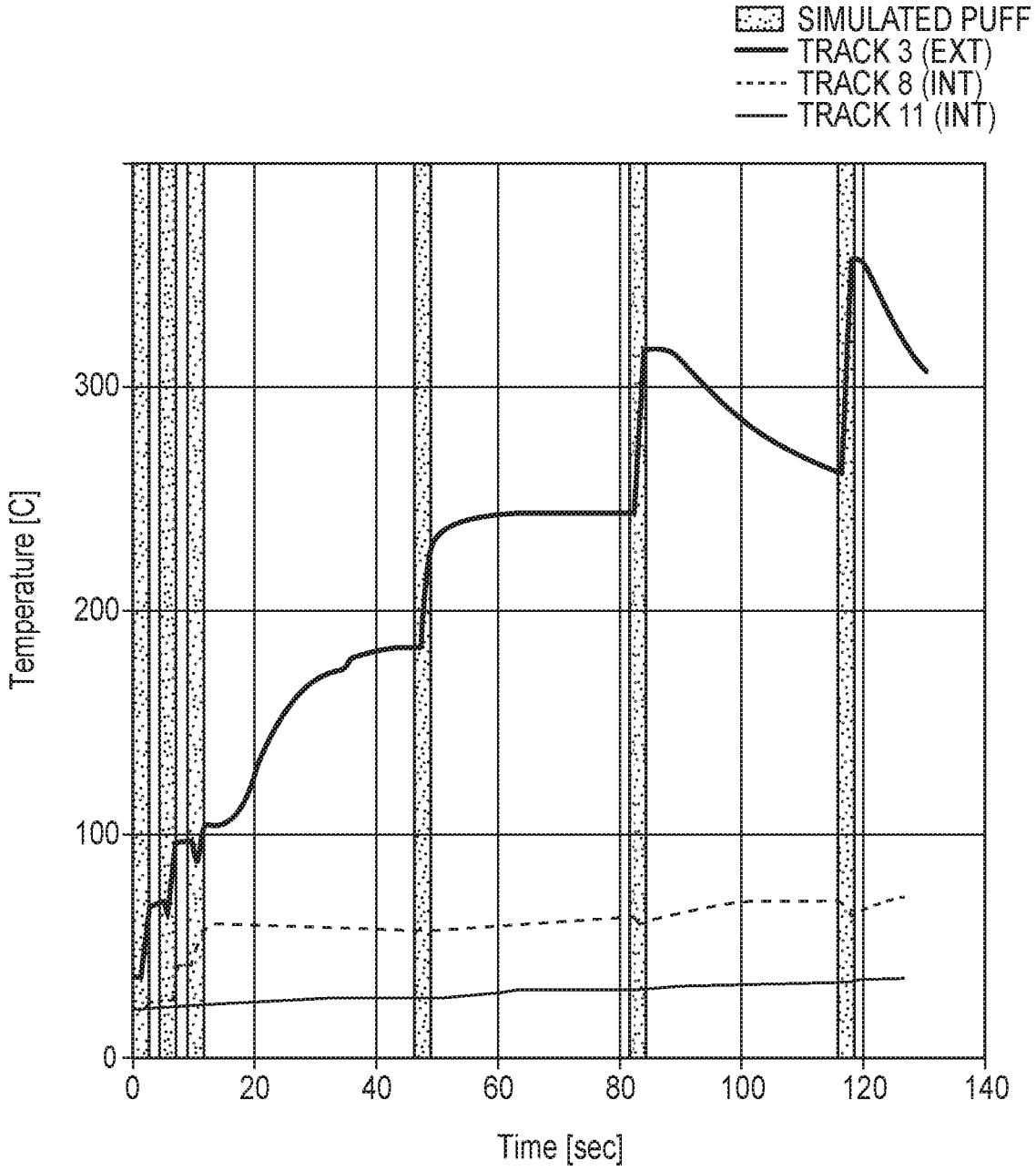
Figure 8:
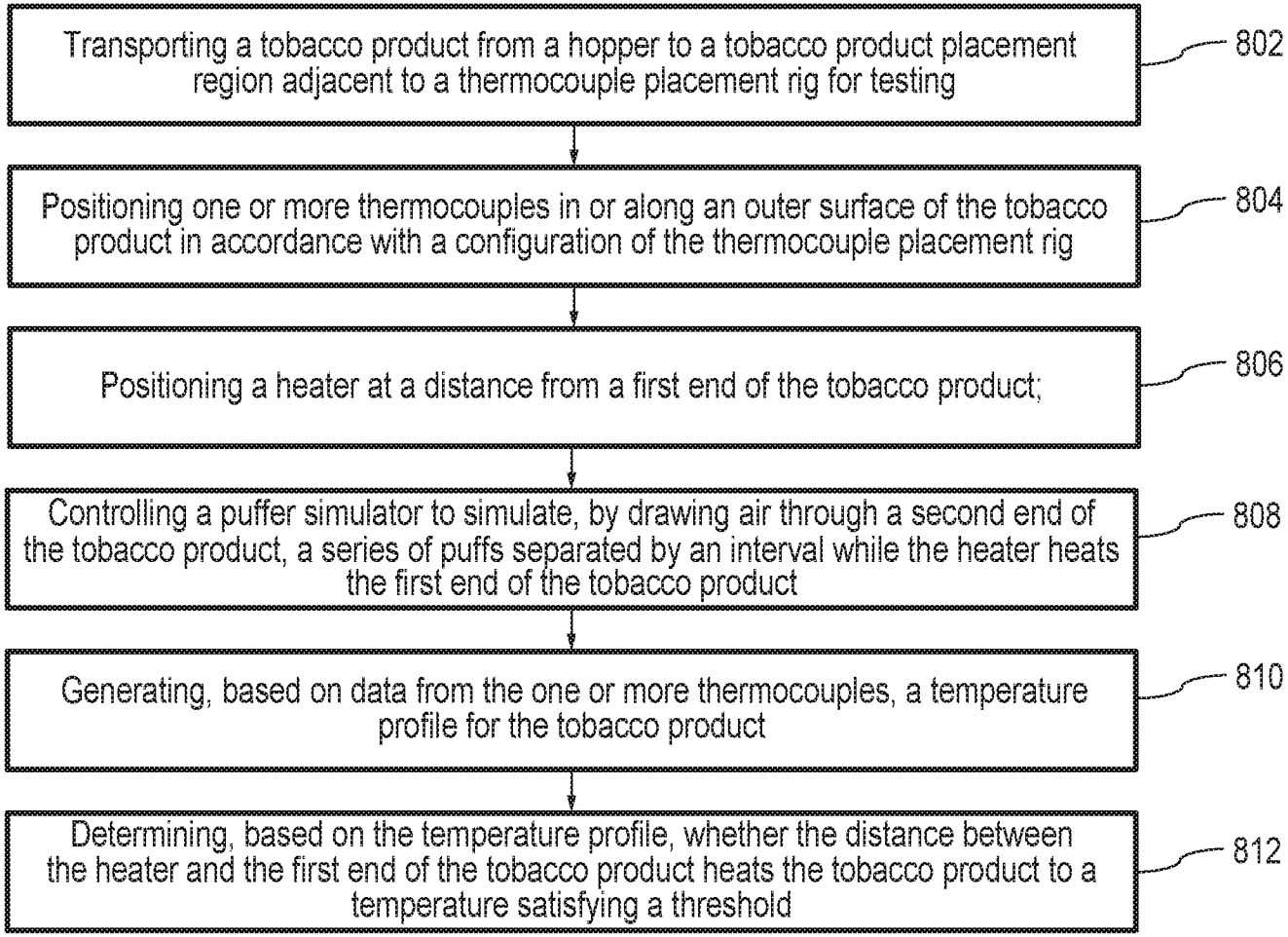

Having thus described the disclosure in general terms, reference will now be made to the accompanying drawings, which are not necessarily drawn to scale, and wherein:

FIG. 1 is a front perspective view of a testing system according to an example embodiment;

FIG. 2 is a schematic view of the testing system of FIG. 1;

FIG. 3 is a perspective view of a transfer assembly for the testing system of FIG. 1;

FIG. 4 is a perspective view of a thermocouple placement rig for the testing system of FIG. 1;

FIG. 5 is an overhead view of a tobacco product placement region including a tobacco product and thermocouples positioned via the thermocouple placement rig of FIG. 4;

FIG. 6 is a puffing simulator assembly for the testing system of FIG. 1;

FIG. 7 is an example temperature profile generated via the testing system of FIG. 1; and FIG. 8 is a flow diagram showing an example method of simulating use of a heat-not-burn tobacco product.

DETAILED DESCRIPTION OF THE DISCLOSURE

The present disclosure now will be described more fully hereinafter with reference to the accompanying drawings, in which some, but not all aspects of the disclosure are shown. Indeed, the disclosure may be embodied in many different forms and should not be construed as limited to the aspects set forth herein; rather, these aspects are provided so that this disclosure will be thorough and complete, will fully convey the scope of the disclosure to those skilled in the art, and will satisfy applicable legal requirements. Like numbers refer to like elements throughout. As used in this specification and the claims, the singular forms "a," "an," and "the" include plural referents unless the context clearly dictates otherwise.

Lightability and Temperature Profile Testing System

Various embodiments described herein relate to a lightability and temperature profile testing system for testing a heat-not-burn (HNB) tobacco product. A system body defines a tobacco product placement region for testing a tobacco product. A heater carrier may be movable with respect to the tobacco product placement region and configured to heat a first end of a tobacco product when the tobacco product is located in the tobacco product placement region. A puffing simulator is configured to fluidically couple to a second end of the tobacco product within the tobacco product placement region. The puffing simulator is configured to draw air through the tobacco product thereby simulating a puff of the tobacco product. A thermocouple placement right is configured to selectively position one or more thermocouples in or along the tobacco product located within the tobacco product placement region. A drill is configured to extend into the system body and selectively drill one or more holes at positions within the tobacco product. The thermocouple(s) are positioned on or within the tobacco product and generate data corresponding to detected temperatures of the tobacco product as the puffing simulator simulates one or more puffs. The testing system described herein may be used for optimizing a heating temperature and location of a heater with respect to the tobacco product in a HNB tobacco product, as described in greater detail below.

Referring to FIG. 1 and FIG. 2, a testing system 100 is shown. The testing system 100 may be used for testing lightability and generating a temperature profile corresponding to a HNB tobacco product. The testing system 100 includes a system body 102. In some embodiments, the system body 102 may carry, support, house, or otherwise include a heater carrier 104, a puffing simulator 106, a drill 108, and a thermocouple placement rig 110. The system body 102 may include or otherwise define a tobacco product placement region 112 for supporting a tobacco product being tested by or with the testing system 100.

In some embodiments, the system body 102 may include a hopper 114. The hopper 114 stores tobacco products to be tested via the testing system 100. An agitator motor 116 coupled to an agitator 118 located beneath a chute 120 for the hopper 114 may rotate the agitator 118 to drop a tobacco product 122 from the chute 120 into a track 124 beneath the agitator 118. A pusher motor 126 coupled to a pusher 128 may push the tobacco product 122 along the track 124 into the tobacco product placement region 112. The thermocouple placement rig 110 positions one or more thermocouples 130 along or within the tobacco product 122 in the tobacco product placement region 112. Where thermocouple(s) 130 are positioned within the tobacco product 122, the drill 108 drills a hole in the tobacco product 122 for positioning the thermocouples 130 in the hole within the tobacco product 122. The thermocouples 130 generate data corresponding to detected temperatures of the tobacco product 122 at various locations. The heater carrier 104 may be positioned at a distance from the tobacco product 122, and the puffing simulator 106 may draw air through the tobacco product 122, simulating a puff of the tobacco product 122. The thermocouples 130 may generate data corresponding to the temperature of the tobacco product 122, which may be used for analyzing various characteristics of the tobacco product 122.

The testing system 100 may include a transfer assembly 132, a testing assembly 134, and a puffing simulator assembly 136. In some embodiments, the transfer assembly 132, the testing assembly 134, and the puffing simulator assembly 136 are mounted, attached, fastened, or otherwise coupled to the system body 102.

The transfer assembly 132 may include the hopper 114, the agitator 118, and the pusher 128 (and corresponding motors 116, 126). The hopper 114 stores tobacco products 122 to be tested. The agitator 118 moves tobacco products 122 from the hopper 114 (e.g., through the chute 120) to the track 124. The pusher 128 pushes a tobacco product 122 along the track 124 to the tobacco product placement region 112.

The testing assembly 134 may include the heater carrier 104, the drill 108, and the thermocouple placement rig 110. The heater carrier 104 receives energy (e.g., electrical energy, chemical energy, etc.) from an energy supply 138, which is converted to heat. The heater carrier 104 may be selectively positioned (e.g., automatically or manually) at various distances from the tobacco product 122 (e.g., an end of the tobacco product 122 closest to tobacco contained therein). The heater carrier 104 thus heats the tobacco within the tobacco product 122.

The thermocouple placement rig 110 may include a number of tracks 140 for positioning thermocouples 130. The thermocouples 130 slide along the tracks 140 at selected positions. The thermocouples 130 may detect temperatures corresponding to the tobacco product 122. In some instances, the thermocouples 130 may detect temperatures along the surface of the tobacco product 122 (e.g., the external surface). In some instances, the thermocouples 130 may detect temperatures inside the tobacco product 122. Hence, some tracks 140 may correspond to internal temperatures, and some tracks 140 may correspond to external temperatures.

The drill 108 may selectively drill holes in the tobacco product 122 when a thermocouple 130 is located on a track 140 corresponding to an internal temperature. The drill 108 may be automatically controlled (e.g., by a controller, as described in further detail below) to drill holes in the tobacco product 122 at locations where the thermocouple(s) 130 measuring internal temperature(s) are to be positioned. The thermocouple(s) 130 may then be positioned inside the holes drilled by the drill 108 and thus measure internal temperatures of the tobacco product 122.

The puffing simulator assembly 136 includes the puffing simulator 106. The puffing simulator 106 may include a puffing cylinder 142 and a piston 144 disposed within the puffing cylinder 142. The piston 144 may be controlled by a piston motor 146. The piston 144 may move up and down within the puffing cylinder 142. As the piston 144 moves up in the puffing cylinder 142, air is drawn into the puffing cylinder 142. The puffing cylinder 142 may be fluidically coupled to the tobacco product 122 in the tobacco product placement region 112. The tobacco product 122 (which is heated by the heater carrier 104) may be tested by simulating a puff of the tobacco product 122 by drawing air through the tobacco product 122. The thermocouples 130 may detect temperatures of the tobacco product 122 inside or along the external surface of the tobacco product 122.

The testing system 100 may include a controller 148. The controller 148 may be or include a component or group of components configured to perform various functions for the testing system 100. For instance, the controller 148 may include a processor and memory. The processor may be a general purpose single- or multi-chip processor, a digital signal processor (DSP), an application specific integrated circuit (ASIC), a field programmable gate array (FPGA), or other programmable logic device, discrete gate or transistor logic, discrete hardware components, or any combination thereof designed to perform the functions described herein. A general purpose processor may be a microprocessor, or, any conventional processor, controller, microcontroller, or state machine. The processor also may be implemented as a combination of computing devices, such as a combination of a DSP and a microprocessor, a plurality of microprocessors, one or more microprocessors in conjunction with a DSP core, or any other such configuration. In some embodiments, particular processes and methods may be performed by circuitry that is specific to a given function.

The memory (e.g., memory, memory unit, storage device) may include one or more devices (e.g., RAM, ROM, EPROM, EEPROM, optical disk storage, magnetic disk storage or other magnetic storage devices, flash memory, hard disk storage, or any other medium) for storing data and/or computer code for completing or facilitating the various processes, layers and modules described in the present disclosure. The memory may be or include volatile memory or non-volatile memory, and may include database components, object code components, script components, or any other type of information structure for supporting the various activities and information structures described in the present disclosure. According to an exemplary embodiment, the memory is communicably connected to the processor via a processing circuit and includes computer code for executing (e.g., by the processing circuit or the processor) the one or more processes described herein.

As described in greater detail below, the controller 148 may include a motor control system 150, a guidance and control system 152, and a temperature profiler 154. Briefly, the motor control system 150 may control the various motors (e.g., agitator motor 116, pusher motor 126, piston motor, 146, etc.). The motor control system 150 may sequentially control the various motors to transport the tobacco product 122 from the hopper 114 into the tobacco product placement region 112, and may control the piston motor 146 to simulate a puff of the tobacco product 122. The guidance and control system 152 may move the drill 108 into various locations to drill holes in the tobacco product 122. The guidance and control system 152 may move the heater carrier 104 into various positions with respect to the tobacco product 122. The temperature profiler 154 may receive data from the thermocouple(s) 130 for generating a temperature profile. The temperature profiler 154 may determine various characteristics for the tobacco product 122 and heating arrangement based on the temperature profile.

Referring now to FIG. 2 and FIG. 3, the transfer assembly 132 is shown in greater detail. The hopper 114 may include a hopper opening 300 at the top of the hopper 114. The hopper 114 may include a first side plate 302, a second side plate 304, a front plate 306, a back plate 308, and the chute 120. The first side plate, 302, second side plate 304, front plate 306, back plate 308, and chute 120 may together define a receiving compartment 310 for storing tobacco products 122. The agitator 118 may be exposed to the chute 120 of the hopper 114. The agitator 118 may prevent tobacco products 122 from exiting the receiving compartment 310. Rather, the agitator 118 may carry tobacco products 122 from the receiving compartment 310 to the track 124. The agitator 118 may include an exterior surface 312 having ridges 314. The ridges 314 may be sized to receive a tobacco product 122 within the hopper 114. Hence, the tobacco product 122 may be sandwiched between the ridges 314 of the agitator 118.

The agitator 118 may be rotated by the agitator motor 116. The agitator motor 116 may in some instances be a stepper motor, but any type of motor may be acceptable. The agitator motor 116 may rotate to agitator 118. As the agitator rotates 118, tobacco products sandwiched between the ridges 314 may rotate with the agitator 118. The motor control system 150 may control the agitator motor 116. In some embodiments, the motor control system 150 may communicate a signal to rotate the agitator motor 116. For instance, the signal may be a pulse width modulated (PWM) signal. The motor control system 150 may communicate the signal responsive to, for instance, a user selecting an initiate testing command (e.g., on a computer communicably coupled to the controller 148, on a button or other input device for the testing system 100, etc.). The signal generated by the motor control system 150 may correspond to an amount of rotation of the agitator 118 for dropping a tobacco product from the hopper 114 into the track. For instance, the amount of rotation may be 180 degrees. The motor control system 150 may communicate the signal to the agitator motor 116, and the agitator motor 116 may correspondingly rotate the agitator 118. The agitator 118 may provide a tobacco product 122 from the hopper 114 to the track 124. The tobacco product 122 may extend longitudinally with respect to (e.g., parallel to the direction of) the track 124.

The pusher 128 may push the tobacco product 122 along the track 124. The pusher 128 may push the tobacco product 122 from beneath the hopper 114/agitator 118 into the tobacco product placement region 112. The pusher 128 may be, for instance, a linear motor, a hydraulic or pneumatic actuator, etc. The pusher motor 126 may drive the pusher 128. The pusher motor 126 may be controlled by the motor control system 150. The motor control system 150 may generate a signal for the pusher motor 126 to drive the pusher 128. In some embodiments, the motor control system 150 may generate the signal for the pusher motor 126 following generating the signal for the agitator motor 116. For instance, the motor control system 150 may generate the signal for the pusher motor 126 a predetermined duration following the motor control system 150 generating the signal for the agitator motor 116. The predetermined duration may be, at least, a duration for the agitator motor 116 to rotate the agitator 118 sufficiently to provide the tobacco product 122 in the track 124. In some embodiments, a sensor (not shown) may be located beneath the track 124 for detecting when a tobacco product 122 is located in the track 124. The sensor may be a pressure or weight sensor, a camera sensor, etc. In each of these embodiments, the motor control system 150 may generate a signal for the pusher motor 126 to drive the pusher 128. The pusher 128 may push the tobacco product 122 along the track 124 into the tobacco product placement region 112. The pusher 128 may extend along the track 124. Referring briefly to FIG. 5, the pusher 128 may push the tobacco product 122 into a receiver 500. The receiver 500 may be connected to the puffing simulator 106. When the tobacco product 122 engages the receiver 500, the tobacco product 122 may be located within the tobacco product placement region 112.

Referring now to FIG. 2 and FIGS. 4 through 5, the thermocouple placement rig 110 is shown in greater detail. The thermocouple placement rig 110 is shown to include a plurality of tracks 140. As can be best seen in FIG. 5, the tracks 140 may extend along an upper interior surface 400 and a lower interior surface 402. The tracks 140 for the upper interior surface 400 may be aligned with corresponding tracks 140 in the lower interior surface 402. Each track 140 may correspond to a particular location of a thermocouple 130 with respect to the tobacco product 122. The thermocouples 130 may have ridges 404 in the upper and lower facing surfaces 406, 408 (e.g., surfaces facing the upper interior surface 400 and lower interior surface 402). The ridges 404 may be sized to engage the tracks 140. As shown, the thermocouple placement rig 110 includes 18 tracks 140. However, in some embodiments, the thermocouple placement rig 110 may include more or less tracks 140 than shown in FIG. 4. Some tracks may correspond to measuring internal temperatures of the tobacco product 122, and some tracks may correspond to measuring external (or surface) temperatures of the tobacco product 122. The thermocouple placement rig 110 may have an interior thermocouple passage 410 defined by the upper interior surface 400, lower interior surface 402, and side walls 412, 414. The passage 410 may be sized to receive a thermocouple 130. The passage 410 may include a first opening 416 shown in FIG. 4, and a second opening 502 shown in FIG. 5. The thermocouples 130 may extend outwardly from the second opening 502, as can be best seen in FIG. 5. The thermocouples 130 may extend over, onto, or into the tobacco product 122.

Referring back to FIG. 1, FIG. 2 and FIG. 5, the drill 108 may be communicably coupled to the controller 148. The guidance and control system 152 may generate commands or signals for the drill 108. The guidance and control system 152 may generate signals for moving the drill 108 and for activating the drill 108. In some embodiments, the drill 108 may be attached, mounted to, or otherwise coupled to various actuators. The guidance and control system 152 may control the various actuators to move the drill 108. The actuators may provide various degrees of freedom for the drill 108. The guidance and control system 152 may communicate control signals for the actuators to move the drill 108 into various locations. The guidance and control system 152 may move the drill 108 based on positions of the thermocouple(s) 130. The guidance and control system 152 may detect the position of the various thermocouples 130 within the thermocouple placement rig 110. The guidance and control system 152 may determine, based on the position of the thermocouples 130, whether the thermocouples 130 are located in slots corresponding to internal temperatures. The guidance and control system 152 may detect the locations of the thermocouples 130 based on user-supplied settings, based on sensors within the thermocouple placement rig 110, etc. The guidance and control system 152 may control the actuators to move the drill 108 for drilling holes in the tobacco product 122 at locations where the thermocouples 130 are positioned for measuring interior temperatures of the tobacco product 122. When the drill 108 is properly positioned, the guidance and control system 152 may control the drill 108 to rotate a drill bit having a size corresponding to the temperature sensitive end 504 of the thermocouple 130. The guidance and control system 152 may control the drill 108 to drill a hole in the tobacco product 122. The guidance and control system 152 may push the drill bit into the tobacco product 122 to a depth corresponding to the temperature sensitive end 504 of the thermocouple 130, and retract the drill bit from the tobacco product 122.

The heater carrier 104 is configured to heat the tobacco product 122. Specifically, the heater carrier 104 may heat a first end 506 of the tobacco product 122. The first end 506 may be the end of the tobacco product including tobacco. The heater carrier 104 may be located a distance from the first end 506. In some embodiments, a user may manipulate the heater carrier 104 to change the distance from the first end 506 of the tobacco product 122. In some embodiments, the guidance and control system 152 may control the heater carrier 104 to change the distance from the first end 506 of the tobacco product 122 (e.g., in a manner similar to the guidance and control system 152 controlling the drill 108 described above). The distance may correspond to a distance of a heater from a tobacco product in a heat-not-burn (HNB) tobacco product. In such products, tobacco is heated by a heater to an elevated temperature (e.g., a temperature sufficient to produce vapors), but less than the temperature for burning the tobacco. The heater carrier 104 may be manipulated to change the distance from the first end 506 of the tobacco product 122. As the distance from the first end 506 increases, less heat is radiated from the heater carrier 104 onto the first end 506 of the tobacco product 122. Correspondingly, as less heat is radiated onto the first end 506, the less the heater heats the tobacco within the tobacco product 122.

Referring now to FIG. 1, FIG. 2, and FIG. 6, the puffing simulator 106 may simulate one or more puffs of the tobacco product 122. As briefly described above, the puffing simulator 106 may include a puffing cylinder 142 and a piston 144. The puffing cylinder 142 may include an interior portion 600. The interior portion 600 may include an inner diameter 602. The piston 144 may be sized to engage the inner diameter 602 of the interior portion 600 of the puffing cylinder 142. The piston 144 may move upwardly and downwardly within the interior portion 600 of the puffing cylinder 142. For instance, the piston motor 146 may control movement of the piston 144 within the interior portion 600 of the puffing cylinder 142. The piston 144 may be coupled to a linear shaft 604. The piston motor 146 may rotate a gear 606 which engages the linear shaft 604. As the gear 606 rotates, the linear shaft 604 (and the piston 144) may move upwardly and downwardly within the interior portion 600 of the puffing cylinder 142. As the piston 144 moves upwardly within the puffing cylinder 142, air may be drawn into the puffing cylinder 142. As the piston 144 moves downwardly within the puffing cylinder 142, air may be pushed out of the puffing cylinder 142.

In some embodiments, the puffing simulator 106 may include a diverter valve 608. The diverter valve 608 may be fluidically coupled to the puffing cylinder 142, the receiver 500 (of FIG. 5) and an outlet. The diverter valve 608 may form a passage between the receiver 500 and the puffing cylinder 142 as the piston 144 moves upwardly within the puffing cylinder 142. The diverter valve 608 may form a passage between the puffing cylinder 142 and outlet when the piston 144 moves downwardly within the puffing cylinder 142. In some embodiments, the controller 148 may control the diverter valve 608. The motor control system 150 may control the diverter valve 608 with the piston motor 146. For instance, when the motor control system 150 controls the piston motor 146 to move the piston 144 upwardly within the puffing cylinder 142, the motor control system 150 may control the diverter valve 608 to open the passage between the puffing cylinder 142 to the receiver 500. The receiver 500 may form a seal with a second end 508 of the tobacco product 122. Accordingly, as the piston 144 moves upwardly within the puffing cylinder 142, air may be drawn through the tobacco product 122, through the receiver 500, and into the puffing cylinder 142 (e.g., via various conduits). When the motor control system 150 controls the piston motor 146 to move the piston 144 downwardly within the puffing cylinder 142, the motor control system 150 may control the diverter valve 608 to open the passage between the puffing cylinder 142 to the outlet. The motor control system 150 may correspondingly seal off the opening to the receiver 500 such that air is not pushed through the tobacco product 122.

Generally speaking, the heater carrier 104 may heat the first end 506 of the tobacco product 122. The puffing simulator 106 may simulate one or more puffs of the tobacco product 122 by drawing air through the tobacco product 122. The thermocouple(s) 130 may generate data corresponding to detected temperatures on, along, or within the tobacco product 122. The thermocouple(s) 130 may communicate the generated data to the controller 148. The controller 148 may include a temperature profiler 154. The temperature profiler 154 may plot the data from the thermocouple(s) 130 over time.

In some embodiments, the puffing simulator 106 may simulate a series of puffs. Referring now to FIG. 7, an example temperature profile generated using the testing system 100 is shown, according to an exemplary embodiment. In the example temperature profile shown in FIG. 7, three thermocouples 130 are used for generating temperature data. A first thermocouple 130 is positioned in track 3, a second thermocouple 130 is positioned in track 8, and a third thermocouple 130 is positioned in track 11. In the example shown in FIG. 7, track 8 and track 11 may correspond to interior temperatures, and track 3 may correspond to an exterior (or surface) temperature. Track 3 may correspond to the temperature sensitive end 504 being near the second end 508 of the tobacco product 122. Track 8 may correspond to the temperature sensitive end 504 being inside and towards the middle of the tobacco product 122. Track 11 may correspond to the temperature sensitive end 504 being inside and towards the first end of the tobacco product 122 (e.g., closest to the heater carrier 104). The puffing simulator 106 may simulate puffs, which are shown as vertically extending highlighted portions of the temperature profile.

As shown, the puffing simulator 106 may simulate a first series of puffs separated by a first interval (e.g., a short duration, such as one to three seconds, between puffs). The first series of puffs may simulate initial puffs for starting the tobacco product 122. The puffing simulator 106 may then simulate a second series of puffs separate by a second interval (e.g., a longer duration, such as 10-30 seconds, between puffs). The second series of puffs may simulate puffs for smoking the tobacco product 122. The thermocouple(s) 130 may generate data corresponding to temperatures in, along, or within the tobacco product 122. The temperature profiler 154 may generate a temperature profile for the tobacco product 122 based on data from the thermocouple(s) 130 as the puffs are simulated. As can be seen, the temperature detected by the temperature sensitive end 504 for the thermocouple 130 in track 11 shows the temperature increasing with every puff, which corresponds to the tobacco being heated by the heater carrier 104. The temperature sensitive end 504 for the thermocouple 130 in track 8 shows the temperature increasing, but tapering off to a steady state temperature. The temperature sensitive end 504 for the thermocouple 130 in track 3 shows the temperature being relatively constant throughout the puffs.

In some embodiments, the temperature profiler 154 may render the plotted data (e.g., the temperature profile) on a display to a user. The controller 148 may be communicably coupled to a display, and the temperature profiler 154 may communicate the temperature profile to the display for rendering. The temperature profiler 154 may output the temperature profile to the display for each thermocouple 130. Hence, the display may display a temperature profile for each thermocouple 130 at each location in the thermocouple placement rig 110. As stated above, some locations along the tobacco product 122 may correspond to measuring internal temperatures of the tobacco product 122. For instance, locations near the second end (e.g. where a user wraps their lips around the tobacco product 122 for inhalation) may correspond to external (or surface) temperatures, and locations near the first end and middle of the tobacco product 122 may correspond to internal temperatures. The thermocouples 130 generate temperature data corresponding to inside the tobacco product 122 or along the external surface of the tobacco product 122 depending on the location of the thermocouples 130. In some embodiments, the temperature profiler 154 generates a temperature profile for each thermocouple 130, with some corresponding to internal temperatures, and some corresponding to external temperatures. The temperature profiler 154 may communicate data corresponding to the temperature profiles to a display for displaying the plots.

The temperature profiler 154 may identify various characteristics for the tobacco product 122 based on the temperature profile and/or temperature data. In some embodiments, the temperature profiler 154 may compare various detected temperatures to a threshold. The temperature profiler 154 may store such thresholds on memory. In some embodiments, the temperature profiler 154 may store a vapor producing threshold, a tobacco burning threshold, and a burn injury threshold. The vapor producing threshold may be a temperature of tobacco which causes the tobacco to produce vapors (or smoke). The vapor producing threshold may be, for instance, between 150 and 350° C. The tobacco burning threshold may be a temperature at which tobacco burns. The tobacco burning threshold may be, for instance, approximately 480° C. The burn injury threshold may be a temperature of the tobacco product which may cause injury to a user. The burn injury threshold may correspond to a temperature of a surface of the tobacco product which, if exposed to skin of a user for an extended duration, may burn the skin of the user. The burn injury threshold may be, for instance, less than 40° C.

The temperature profiler 154 may determine, based on the temperature profile, whether the tobacco product being tested satisfies various thresholds. For instance, the temperature profiler 154 may compare the detected temperatures to the various thresholds. The temperature profiler 154 may determine whether the particular configuration of the heater carrier 104 in relation to the first end 506 of the tobacco product 122 sufficiently heats the tobacco. The heater carrier 104 may sufficiently heat the first end 506 when the temperature profile satisfies the various thresholds. For instance, the heater carrier 104 may sufficiently heat the first end 506 when the heater carrier 104 heats the tobacco to a temperature that is less than the tobacco burning threshold, but falling within the vapor producing threshold. The heater carrier 104 may sufficiently heat the first end 506 when the temperature of a surface of the tobacco product 122 in contact with a person is less than the burn injury threshold.

Where the temperature profiler 154 determines that the tobacco product 122 does not satisfy various thresholds, the distance between the heater carrier 104 and first end 506 may be changed (e.g., the heater carrier 104 may be moved closer to or further from the first end 506). In some embodiments, particularly those where the energy supply 138 provides electrical energy to the heater carrier 104, the temperature of the heater carrier 104 may be changed. In each of these embodiments, the relationship between the heater carrier 104 and first end 506 may be modified to change various characteristics until the tobacco product 122 satisfies various thresholds. In this regard, the arrangements described herein may provide for optimization of the configuration of the tobacco product 122 and heater carrier 104. Once the configuration is optimized, a corresponding heat-not-burn tobacco product may be produced according to the specifications (e.g., distance between heater carrier 104 and first end of the tobacco product 122, temperature of the heater carrier 104, etc.) generated via the optimization from the testing system 100.

Method of Simulating Use of a Heat-Not-Burn (HNB) Tobacco Product

In various embodiments, the invention described herein relates to a method of simulating use of a heat-not-burn tobacco product (e.g., through the testing system 100 described above with respect to FIGS. 1 through 7).

Referring to FIG. 8, a flow diagram of a method 800 of simulating use of a heat-not-burn tobacco product is shown according to an example embodiment. The method 800 may be performed by the various components of the testing system 100 described above in detail. In some embodiments, various steps may be added to or removed from the method 800 shown in FIG. 8. Hence, the present disclosure is not limited to the particular steps in FIG. 8.

Method 800 begins when a tobacco product 122 is transported from the hopper 114 to a tobacco product placement region 112 adjacent to a thermocouple placement rig 110 for testing at 802. A motor control system 150 may control an agitator motor 116 to rotate an agitator 118, which may transport tobacco products from the hopper 114 to a track 124. The motor control system 150 may control the pusher motor 126 to cause the pusher 128 to push the tobacco product along the track 124 into the tobacco product placement region 112.

One or more thermocouples 130 are positioned in or along an outer surface of the tobacco product 122 in accordance with a configuration of the thermocouple placement rig 110 at 804. The thermocouple placement rig 110 may include a number of tracks which correspond to locations of the thermocouple(s) 130 in or along the tobacco product 122. Where a thermocouple 130 is located at a position within the tobacco product 122, the guidance and control system 152 may control the drill 108 to drill a hole at a location of the tobacco product 122 such that the temperature sensitive end of the thermocouple 130 may be situated within the tobacco product 122.

The heater carrier 104 is positioned a distance from a first end of the tobacco product 122 at 806. The heater carrier 104 may be controlled to move to the distance from the first end of the tobacco product 122 (e.g., by the guidance and control system 152). In some embodiments, a user may control the heater carrier 104. The heater carrier 104 may heat the first end of the tobacco product 122.

The puffing simulator 106 is controlled to simulate a series of puffs separated by an interval while the heater carrier 104 heats the first end of the tobacco product 122 at 808. The puffing simulator 106 may draw air through the tobacco product 122 to simulate a puff of the tobacco product 122. The puffing simulator 106 may simulate a initial puffs of the tobacco product 122 for starting the tobacco product 122, and the puffing simulator 106 may simulate subsequent puffs of the tobacco product 122 for smoking the tobacco product 122. Such puffs may be separated by different intervals.

A temperature profile is generated for the tobacco product 122 based on data from the thermocouples 130 at 810. The thermocouples 130 may generate temperature data as the puffing simulator 106 simulates puffs of the tobacco product 122. The temperature sensitive ends 504 of the thermocouples 130 may detect the temperature of inside the tobacco product 122 at various locations, and along the external surface of the tobacco product 122 (depending on the configuration of the thermocouple placement rig 110). The thermocouples 130 may provide the temperatures to the controller 148, and a temperature profiler 154 may plot the temperatures over time to generate a temperature profile for the tobacco product 122.

The temperature profiler 154 determines whether the distance between the heater carrier 104 and the first end of the tobacco product 122 sufficiently heats the tobacco product 122 to a temperature that satisfies a threshold at 812. The temperature profiler 154 may compare the detected temperatures from the thermocouples 130 to the various thresholds. The temperature profiler 154 may determine whether the particular configuration of the heater carrier 104 in relation to the first end 506 of the tobacco product 122 sufficiently heats the tobacco. The heater carrier 104 may sufficiently heat the first end 506 when the temperature profile satisfies the various thresholds. For instance, the heater carrier 104 may sufficiently heat the first end 506 when the heater carrier 104 heats the tobacco to a temperature that is less than the tobacco burning threshold, but falling within the vapor producing threshold. The heater carrier 104 may sufficiently heat the first end 506 when the temperature of a surface of the tobacco product 122 in contact with a person is less than the burn injury threshold.

Many modifications and other aspects of the disclosures set forth herein will come to mind to one skilled in the art to which these disclosures pertain having the benefit of the teachings presented in the foregoing descriptions and the associated drawings. Therefore, it is to be understood that the disclosures are not to be limited to the specific aspects disclosed and that equivalents, modifications, and other aspects are intended to be included within the scope of the appended claims. Although specific terms are employed herein, they are used in a generic and descriptive sense only and not for purposes of limitation.

That which is claimed:

1. A lightability and temperature profile testing system, comprising:

a system body defining a tobacco product placement region for testing a tobacco product;

a heater carrier movable with respect to the tobacco placement region and configured to heat a first end of a tobacco product;

a puffing simulator configured to fluidically couple to a second end of the tobacco product within the tobacco product placement region, the puffing simulator configured to draw air through the tobacco product thereby simulating a puff of the tobacco product;

a thermocouple placement rig configured to selectively position one or more thermocouples in or along the tobacco product located within the tobacco product placement region;

a drill configured extend into the system body and selectively drill one or more holes at positions within the tobacco product located within the tobacco product placement region; and a controller communicably coupled to the heater carrier, the puffing simulator, the thermocouple placement rig and the drill, the controller executing instructions to:

identify, based on a configuration of the thermocouple placement rig, at least one position for drilling a hole in the tobacco product;

control the drill to drill the hole at the at least one position in the tobacco product;

position, via the thermocouple placement rig, the one or more thermocouples in or along the tobacco product;

control the puffing simulator to draw air through the tobacco product; and while the puffing simulator draws air through the tobacco product, generate, based on temperature data from the thermocouples, a temperature profile for the tobacco product.

2. The lightability and temperature profile testing system of claim 1, further comprising:

a hopper configured to store one or more tobacco products to be tested including the tobacco product.

3. The lightability and temperature profile testing system of claim 2, further comprising:

a motor configured to rotate an agitator located at a chute for the hopper, the agitator having tracks for receiving the one or more tobacco products stored in the hopper and dropping the one or more tobacco products from the tracks into a slot.

4. The lightability and temperature profile testing system of claim 3, further comprising:

a pusher positioned beneath the hopper and configured to push the tobacco product positioned in the slot into the tobacco product placement region of the system body.

5. The lightability and temperature profile testing system of claim 1, wherein the controller is further configured to:

determine, based on the temperature data, whether the heater adjacent to the first end of the tobacco product heats the tobacco product to produce vapors.

6. The lightability and temperature profile testing system of claim 1, wherein the controller is further configured to:

determine, based on the temperature data, whether heat produced by the heater is below a tobacco burning threshold corresponding to burning tobacco positioned within the tobacco product.

7. The lightability and temperature profile testing system of claim 1, wherein the controller is further configured to:

determine, based on the temperature data, whether heat produced by the heater is below a burn injury threshold.

8. The lightability and temperature profile testing system of claim 1, wherein the puffing simulator comprises:

a puffing cylinder having an interior chamber; and a piston positioned in the interior chamber of the puffing cylinder and configured to draw air into the interior chamber as the piston is retracted from the puffing cylinder.

9. The lightability and temperature profile testing system of claim 1, wherein the thermocouple placement rig comprises:

a plurality of slots defining available positions of thermocouples on or within the tobacco product, wherein at least one of the plurality of slots corresponds to an available position of a thermocouple within the tobacco product, and at least one of the plurality of slots corresponds to an available position of a thermocouple along an outer surface of the tobacco product.

10. The lightability and temperature profile testing system of claim 1, further comprising:

the tobacco product.

11. A method of testing lightability for a heat-not-burn (HNB) tobacco product, the method comprising:

transporting a tobacco product from a hopper to a tobacco product placement region adjacent to a thermocouple placement rig for testing;

positioning one or more thermocouples in or along an outer surface of the tobacco product in accordance with a configuration of the thermocouple placement rig;

positioning a heater carrier at a distance from a first end of the tobacco product;

controlling a puffer simulator to simulate, by drawing air through a second end of the tobacco product, a series of puffs separated by an interval while the heater carrier heats the first end of the tobacco product;

generating, based on data from the one or more thermocouples, a temperature profile for the tobacco product; and determining, based on the temperature profile, whether the distance between the heater carrier and the first end of the tobacco product heats the tobacco product to produce vapors.

12. The method of claim 11, wherein controlling the puffer simulator comprises:

controlling the puffer simulator to simulate, by drawing air through the second end of the tobacco product, at least three puffs of a first interval, each puff separated by a second interval smaller than the first interval while the heater carrier heats the first end of the tobacco product.

13. The method of claim 11, wherein determining whether the distance between the heater carrier and the first end of the tobacco product heats the tobacco product to produce vapors comprises: determining whether the one or more thermocouples detects an increase in temperature that exceeds a vapor producing threshold.

14. The method of claim 11, wherein a thermocouple of the one or more thermocouples is positioned adjacent to the first end of the tobacco product, and another thermocouple of the one or more thermocouples is positioned adjacent to the second end of the tobacco product.

15. The method of claim 14, further comprising: determining, based on the temperature profile, whether data generated by the thermocouple positioned adjacent to the second end indicates a temperature at the second end that is less than a burn injury threshold.

16. The method of claim 11, wherein determining whether the distance between the heater carrier and the first end of the tobacco product heats the tobacco product to produce vapors comprises: determining, based on the temperature profile, whether the distance between the heater carrier and the first end of the tobacco product heats the tobacco product to a temperature between a vapor producing threshold and a tobacco burning threshold.

17. A method of simulating use of a heat-not-burn (HNB) tobacco product, the method comprising:

positioning one or more thermocouples in or along an outer surface of a tobacco product in accordance with a configuration of a thermocouple placement rig;

positioning a heater carrier at a distance from a first end of the tobacco product;

controlling a puffer simulator to simulate, by drawing air through a second end of the tobacco product, a series of puffs separated by an interval while the heater carrier heats the first end of the tobacco product; and generating, based on data from the one or more thermocouples, a temperature profile for the tobacco product; and determining, based on the temperature profile, whether the distance between the heater carrier and the first end of the tobacco product heats the tobacco product to a temperature threshold.

18. The method of claim 17, wherein the threshold is a vapor producing threshold.

19. The method of claim 17, wherein the threshold is a range between a vapor producing threshold and a tobacco burning threshold.

20. The method of claim 17, wherein at least one of the one or more thermocouples is positioned adjacent to the second end of the tobacco product, and wherein the threshold is a burn injury threshold.

* * * * *